US009745180B2

(12) United States Patent
Meijer et al.

(10) Patent No.: US 9,745,180 B2
(45) Date of Patent: Aug. 29, 2017

(54) MANUALLY LENGTH-ADJUSTABLE FORK FOR A LIFTING DEVICE, FORKLIFT TRUCK PROVIDED THEREWITH AND METHOD THEREFOR

(71) Applicant: Gebr. Meijer St. Jabik B.V., Sint Jacobiparochie (NL)

(72) Inventors: Hendrik Meijer, Sint Jacobiparochie (NL); Joris Van De Wal, Willemsoord (NL)

(73) Assignee: Gebr. Meijer St. Jabik B.V., Sint Jacobiparochie (NL)

( * ) Notice: Subject to any disclaimer, the term of this patent is extended or adjusted under 35 U.S.C. 154(b) by 0 days.

(21) Appl. No.: 14/309,277

(22) Filed: Jun. 19, 2014

(65) Prior Publication Data

US 2014/0374193 A1 Dec. 25, 2014

(30) Foreign Application Priority Data

Jun. 21, 2013 (NL) ..... 2011022
Mar. 11, 2014 (NL) ..... 2012404

(51) Int. Cl.
*B66F 9/12* (2006.01)

(52) U.S. Cl.
CPC ..... *B66F 9/12* (2013.01); *B66F 9/122* (2013.01)

(58) Field of Classification Search
CPC ..... B66F 9/12; B66F 9/122
USPC ..... 187/237; 292/57, 60, 61, 137, 163, 173, 292/175, 143, 145, 147, 150, 268, 269, 292/273, 277
See application file for complete search history.

(56) References Cited

U.S. PATENT DOCUMENTS 168,986 A * 10/1875 Griscom ..... E05B 63/044 292/245
173,742 A * 2/1876 Tewsbury ..... E05B 65/0864 292/60
2,788,909 A * 4/1957 Kughler ..... B66F 9/122 414/639
4,002,256 A * 1/1977 Kroboth ..... B66F 9/12 403/328
4,294,089 A * 10/1981 Best ..... E05B 55/00 292/169.18
2005/0129494 A1* 6/2005 Chandler ..... E02F 3/962 414/607
2009/0189132 A1* 7/2009 Meijer ..... B62B 3/06 254/2 R (Continued)

FOREIGN PATENT DOCUMENTS

DE 19729124 A1 1/1999
DE 10216076 C1 12/2003

(Continued)

*Primary Examiner* — Michael Riegelman
(74) *Attorney, Agent, or Firm* — The Webb Law Firm

(57) ABSTRACT

Disclosed is a manually length-adjustable fork for a lifting device such as a forklift truck, a forklift truck provided therewith, and a method therefor. The fork includes a fixed fork part; an adjustable fork part displaceable relative to the fixed fork part and provided from a tubular profile which is for a large part open on the side facing downward during use; and a locking mechanism connected to the fixed fork part and provided with a locking catch, a spring mechanism and a fastener accessible from an underside for manual operation of the locking catch.

12 Claims, 8 Drawing Sheets

(56) References Cited

U.S. PATENT DOCUMENTS

| | | | | |
|---|---|---|---|---|
| 2009/0314582 | A1* | 12/2009 | Meijer | B66F 9/122 187/237 |
| 2012/0211308 | A1* | 8/2012 | Issartel | B66F 17/003 187/237 |
| 2014/0299418 | A1* | 10/2014 | Meijer | B66F 9/08 187/234 |

FOREIGN PATENT DOCUMENTS

| | | | | |
|---|---|---|---|---|
| DE | 202011000817 | U1 | 6/2011 | |
| EP | 1449807 | A1 | 8/2004 | |
| EP | 2484627 | A1 | 8/2012 | |
| GB | 2121759 | A * | 1/1984 | B66F 9/122 |

* cited by examiner

MANUALLY LENGTH-ADJUSTABLE FORK FOR A LIFTING DEVICE, FORKLIFT TRUCK PROVIDED THEREWITH AND METHOD THEREFOR

CROSS REFERENCE TO RELATED APPLICATIONS

This application claims priority to The Netherlands Patent Applications No. 2011022 and No. 2012404 filed Jun. 21, 2013 and Mar. 11, 2014, respectively, the disclosures of which are hereby incorporated in their entirety by reference.

BACKGROUND OF THE INVENTION

Field of the Invention

The present invention relates to a fork which is adjustable in the length manually, i.e. by hand, and which is applied in practice for displacing goods with for instance a forklift truck.

Description of Related Art

Forklift trucks are known in practice wherein forks are used to pick up, displace and subsequently set goods down again. The forklift trucks known in practice can be provided here with length-adjustable forks, wherein the forks are provided for the purpose of lengthening thereof with a drive for realizing the displacement of a sliding part relative to a fixed support part of the fork. The drive used is hydraulic, pneumatic or electrical. A drive is therefore required here for lengthening or shortening the forks. This has the effect of increasing the cost of the forks, and therefore the whole forklift truck. Additional maintenance is also required.

Forks which can be extended manually, i.e. by hand, are likewise known in practice. A problem occurring here is that of providing a locking mechanism which on the one hand guarantees safe operation of the forks during pick-up, displacement and setting-down of goods and which on the other can be set manually in respect of the fork length in safe and efficient manner.

The present invention has for its object to provide a fork which obviates, or in any case reduces, the above stated problems.

SUMMARY OF THE INVENTION

This object is achieved with the manually length-adjustable fork according to the present invention for a lifting device such as a forklift truck, wherein the fork comprises:

a fixed fork part;

an adjustable fork part displaceable relative to the fixed fork part and provided from a tubular profile which is for a large part open on the side facing downward during use; and a locking mechanism connected to the fixed fork part, wherein the locking mechanism is provided with:

- a locking catch for locking the adjustable fork part to the fixed fork part;
- a spring mechanism operatively connected to the locking catch; and
- a fastener accessible during use from the downward facing side of the tubular profile for manual operation of the locking catch.

Providing a fixed fork part and an adjustable fork part displaceable relative thereto achieves that the fork is adjustable manually, i.e. by hand, in the length. By providing a locking mechanism the two relatively displaceable fork parts are fixed or locked relative to each other in a mode of use in which goods can be picked up, displaced and/or set down.

According to the invention use is made here of a locking catch which mutually locks the two fork parts. Use is made here of a spring mechanism which exerts a spring force on the locking catch in order to hold it in the locked position in which the two fork parts are locked to each other.

In a currently preferred embodiment the locking mechanism is provided on the fixed fork part, wherein the locking catch is arranged in the locking mechanism for movement relative to the fixed fork part. Preferably provided in the adjustable fork part are a number of recesses or openings in which the locking catch can be arranged. More particularly the locking catch can be pressed using the spring mechanism into such a recess or opening as soon as this recess or opening in the adjustable fork part is positioned at the location of the locking catch of the locking mechanism. The locking catch is in this way preferably pressed laterally outward by the spring mechanism. In this currently preferred embodiment the locking catch drops in the mode of use into one of the recesses and/or openings arranged in the adjustable fork part. Locking of the adjustable fork relative to the fixed fork part is hereby realized. For the purpose of unlocking the two fork parts in order to enable a relative displacement and change in length of the fork, the locking catch has to be displaced counter to the spring force out of the recess or opening.

According to the invention the adjustable fork part is provided from a tubular profile. In a currently preferred embodiment the tubular profile of the adjustable fork part is embodied such that the adjustable fork part as it were slides over the fixed fork part when the fork is lengthened or shortened. The tubular profile is for a large part open on the side facing downward during use. The extent to which this underside is open preferably amounts to more than 50%, and more preferably more than 70% of the underside. Providing such an open tubular profile for the adjustable fork part makes the fastener for manual operation of the locking catch accessible in a mode of use via this downward facing side of the tubular profile.

Providing the fastener so that it is accessible from below achieves that the locking catch can be displaced in relatively simple manner out of the recess or opening which in a currently preferred embodiment is provided in the adjustable fork part, in particular in the side wall thereof. The locking catch hereby need not itself be pressed in manually from for instance an outer side during simultaneous sliding of the adjustable fork part. Hereby avoided with the present invention is that for instance fingers can become caught in this opening or recess. Safe operation of the locking mechanism is therefore achieved by accessing a fastener from below with which the locking catch can be displaced.

An additional advantage lies in the fact that, due to the relatively simple access to the opening in the tubular profile facing downward during use, the locking mechanism is readily accessible for inspection and/or maintenance. This increases safety of operation with such a mechanism for manually length-adjustable forks, and in addition further enhances convenience of maintenance.

The locking mechanism preferably comprises a part arranged on the fixed fork part and provided with a slotted hole such that the fastener is movable therein during the manual adjustment of the fork. By preferably providing the locking mechanism on the fixed fork part, wherein the locking mechanism comprises a slotted hole in a fixed part, the fastener accessible from the downward facing side of the tubular profile can be moved manually in simple manner in a slotted hole. The locking catch can hereby be moved in relatively simple manner counter to the spring force of the spring mechanism in order to thus enable unlocking of the fixed fork part and the adjustable fork part and to be able to perform displacement of the adjustable fork part relative to the fixed fork part. This provides for safe operation of the locking mechanism, whereby a user can avoid having to place for instance fingers in or through an opening or recess in order to operate the locking mechanism. This results in a fork according to the invention which is manually adjustable in effective and safe manner.

In an advantageous preferred embodiment according to the present invention the slotted hole is provided with a clearance in a direction substantially perpendicularly of the direction in which the slotted hole extends such that during use the locking catch is connected with a contact surface to a contact surface of the adjustable fork part.

In the case of a load on the fork it is found in practice that a small angular displacement can occur between the fixed fork part and the adjustable fork part. This occurs for instance when the adjustable fork part is loaded in the extended position of the fork. Such a displacement is for instance possible in practice due to a small clearance or production tolerance in the guides with which the adjustable fork part and the fixed fork part are displaceable relative to each other. In the case such a relatively small angular displacement occurs in practice, the load is exerted in another way on the locking catch. A relatively large point load could occur here, whereby for instance the locking catch is bent or can even break off. Providing a small clearance in the slotted hole such that the locking catch can make a rotation movement over preferably a few degrees about the axis along which the locking catch is slidable in and out through the opening or in the recess which in a currently preferred embodiment is provided in the adjustable fork part, achieves that a kind of positioning or orienting effect is realized, wherein, due to the load applied to the locking catch, the locking catch rotates to some extent such that a point load is avoided and a contact surface of the locking catch is in contact with, and preferably also remains during use in contact with a contact surface of the adjustable fork part. The transmission of forces to the locking catch is in this way distributed more uniformly over a surface and no damage will be caused to the locking catch. The amount of damage and the associated disruptions and/or maintenance operations are hereby greatly reduced. It is also found that the lifespan of the locking catch, the locking mechanism as a whole, and thereby of the whole manually length-adjustable fork, is hereby greatly increased. In addition, a forklift truck or other lifting device can hereby be embodied in even more advantageous manner with a manually length-adjustable fork according to the invention.

The locking catch is preferably provided with a rectangular form. This achieves that the force transmission can be performed over a greater contact area. In a currently preferred embodiment the force will be transmitted in practice from the adjustable fork part to the locking catch. The opening or recess in the adjustable fork part is for this purpose preferably provided with the same form as the locking catch.

The locking catch is preferably also provided with a locking body which extends in the direction of movement of the catch during locking and unlocking. In a currently preferred embodiment the locking body extends through a distance almost equal to the width of the fixed fork part. This achieves a good guiding of the locking catch, thereby avoiding the locking catch being pushed askew or catching.

In an advantageous preferred embodiment according to the present invention the fastener is provided removably in the locking mechanism.

Providing the fastener removably in the locking mechanism achieves that assembly and disassembly of the fastener and/or locking catch with optional locking body is possible in effective manner, and maintenance is easy to perform. Optional removal of the fastener brings about a fixed setting of the adjustable fork, whereby unauthorized adjustment of the adjustable fork is not possible. Safety can hereby be further increased.

The locking mechanism is preferably provided with an additional outward bending compensation clearance in a direction substantially perpendicularly of the length adjustment direction of the fork. In the case of an extreme load being applied the adjustable fork part could bend laterally outward. Providing the compensation clearance achieves that the locking catch can compensate such outward bending to some extent. It has thus been found in a preferred embodiment that an outward bending of for instance about 5 mm can be compensated while locking of the fork parts continues to function.

The locking catch is likewise preferably provided during use on one substantially laterally oriented side of the fork. Having the locking catch move in a lateral direction, i.e. substantially perpendicularly of the lengthwise direction in which the fork extends, achieves that the locking catch cannot be displaced by a load on the fork. Providing the locking catch on only one substantially laterally oriented side during use on the one hand further ensures in effective manner a proper locking in a mode of use and on the other makes simple operation possible. Through the use of the fastener an operation of the locking mechanism is preferably hereby possible with one hand such that the operator can displace the adjustable fork part relative to the fixed fork part with the other hand. A driver of a lifting device provided with the fork according to the invention can hereby independently adjust the length of the fork. An effective adjustment of the fork length is hereby made possible. The fork can hereby also be assembled from relatively simple production parts, and relatively precise, and thereby costly, manufacture of components is not required.

In an advantageous preferred embodiment according to the present invention the adjustable fork part is provided with a handle or handgrip for displacing the adjustable fork part relative to the fixed fork part.

By providing a handle the adjustable fork part can be displaced relative to the fixed fork part in simple manner by a user. Use is preferably made here of a locking mechanism as described above, wherein a user can move the fastener with one hand such that the locking catch preferably provided on one side is pressed away out of the recess or opening provided in the adjustable fork part, and can slide the adjustable fork part relative to the fixed fork part with the other hand. An adjustment of the fork hereby becomes possible which is easy to carry out in practice.

In a further advantageous preferred embodiment according to the present invention the fork comprises a secondary locking arranged on the fixed fork part.

Providing a secondary locking in addition to the above discussed locking mechanism imparts additional safety.

The secondary locking preferably comprises a wear plate which is preferably arranged on the fixed fork part. In a currently preferred embodiment the wear plate makes contact here at a maximum length of the fork with a contact surface or stop on the adjustable fork part such that the adjustable fork part cannot be pushed from or out of the fixed fork part. This further increases the safety of the fork.

In an advantageous preferred embodiment according to the invention the locking mechanism further comprises a lubricating means.

A good operation of the locking mechanism, and in particular the movement of the locking catch therein, is realized over a long period by providing a lubricating means. This increases the lifespan of the locking mechanism and reduces maintenance and the risk of failure. The lubrication is for instance realized by supplying a lubricating oil via for instance the fastener which is provided with an internal channel for carrying the lubricating oil to the desired positions. In a currently preferred embodiment the locking body is provided for this purpose with a lubricator chamber.

The invention further relates to a forklift truck provided with a manually length-adjustable fork as described above.

Such a forklift truck has the same effects and advantages as those described in respect of the fork.

The invention further relates to a method for manually lengthening and/or shortening a manually length-adjustable fork as described above, the method comprising of:

- providing the manually length-adjustable fork as described above;
- unlocking the adjustable fork part with the locking mechanism;
- displacing the adjustable fork part relative to the fixed fork part from the underside of the fork; and
- locking the adjustable fork part at a desired position with the locking mechanism.

Such a method provides the same effects and advantages as those described in respect of the fork and/or the forklift truck.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION OF THE INVENTION

Figure 1:
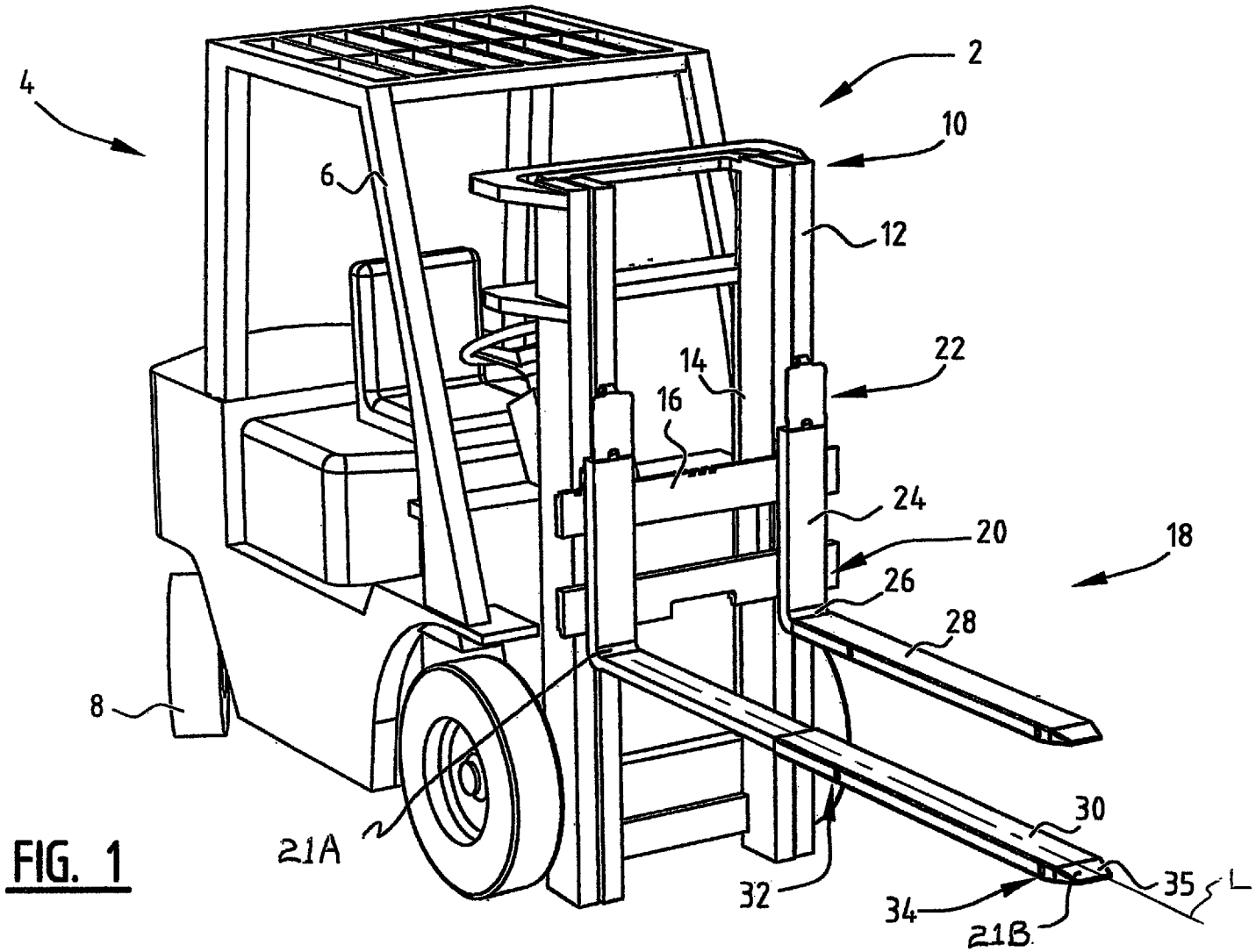
FIG. 1 shows a view of a forklift truck provided with a manually length-adjustable fork according to the invention.

A forklift truck 2 (FIG. 1) is provided with cab 4, frame 6 and a number of wheels 8. Mast construction 12 is provided on front side 10 of forklift truck 2. In the shown embodiment construction 12 is provided with two guides 14 in which or on which fork board 16 is arranged. Two forks 18 according to the invention are arranged on fork board or connecting element 16.

Fork 18 consists of a fixed fork part 20. Fixed fork part 20 is provided at a first outer end 21A with a number of mounting points or mounting elements 22 for mounting on element 16. Via a first part 24 oriented substantially vertically during use and a bend 26 the fixed fork part 20 transposes into a second part 28 which is substantially horizontal during use. In the shown embodiment second fork part 28 connects to the adjustable fork part 30 which is slidable thereover. In the shown embodiment adjustable fork part 30 is provided with a first recess 32 for a mode of use with a lengthened fork, and a second recess 34 for a mode of use with a shortened fork. A plurality of intermediate recesses are optionally possible for the purpose of thereby realizing further adjustable fork lengths. A nose element 35 is situated on the front side, i.e. at the free second outer end 21B of fork 18. Nose element 35 is inserted under the goods to be picked up. The second outer end 21B is forward of the first outer end 21A along a longitudinal axis L.

Figure 2:
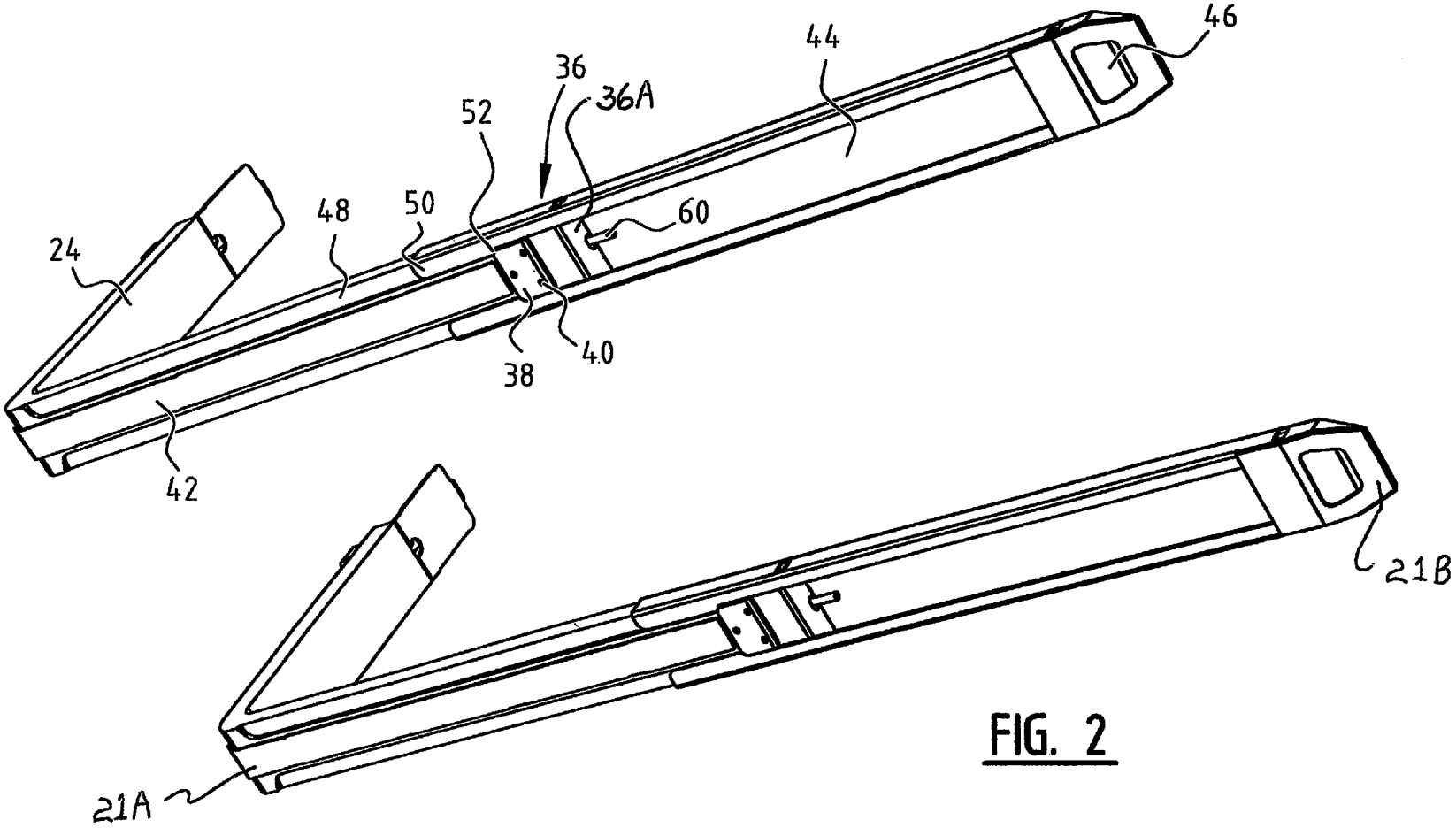
FIG. 2 shows a bottom view of the forks of FIG. 1.

In the shown embodiment the outer end of fixed fork part 20 is provided with locking mechanism 36 (FIG. 2). Close to locking mechanism 36 a locking plate or wear plate 38 is also arranged on fixed fork part 20 using a number of clamping bushes 40. Wear strip 42 is situated in lengthwise direction of second part 28 of fixed fork part 20. Adjustable fork part 30 is formed from a tubular profile, wherein an open space 44 is provided on the underside. Provided close to nose 35 of adjustable fork part 30 is a recess or handle/handgrip 46 for the purpose of manually sliding adjustable fork part 30 in and/or out. Fork part 30 slides over guide surfaces 48 using bent edge 50. In the shown embodiment edge 50 is provided at the outer end remote from nose 35 with a stop surface 52. In a maximally extended/lengthened position of adjustable fork part 30 the stop 52 comes into contact with locking plate 38. In the shown embodiment locking plate 38 is mounted with clamping bushes 40 on fixed fork part 20. For removal of plate 38 clamping bushes 40 can be struck via continuous holes into fixed fork part 20. Clamping bushes 40 can be struck out of fork 18 again via continuous holes.

Locking mechanism 36 (FIG. 3) comprises a locking block 54 which is fixedly connected to fixed fork part 20. Locking mechanism 36 is further provided with a strip or element 56, which in the shown embodiment is arranged fixedly on block 54 and in which a slotted hole 58 is arranged. Locking pin or operating pin 60 is provided movably in slotted hole 58, wherein pin 60 is secured with screw thread 62 in locking body or locking element 64 which is movable relative to locking block 54. Access to the locking pin 60 is from the underside of the tubular profile and also from the forwardly facing side 36A (FIG. 2) of the locking mechanism 36 when the fork is in an elevated position. Catch 66 protrudes in the locked situation wholly or partially through one of the openings 32, 34 in adjustable fork part 30. In the shown embodiment catch 66 is provided on one side of fork 18.

The upper edge 68 of catch 66 facing upward during use lies against the upper edge of one of the openings 32, 34 when adjustable fork part 30 is loaded. Catch 66 is pressed by spring 70 through one of the openings 32, 34, wherein in the shown embodiment spring 70 is arranged wholly or partially in chamber 72 of element 64 and supports on the other side against the fixedly disposed partition 74 connected to locking block 54.

Element 64 is provided movably in a direction B which is substantially perpendicular to the sliding direction A, also called the adjustment direction, of adjustable fork part 30 relative to fixed fork part 20. In the shown embodiment element 64 is embodied as a round rod, wherein at the outer end locking catch 66 is provided with a square form. Slotted hole 58 is provided with an additional clearance 76 substantially as seen in direction of movement B of pin 60. Owing to the extra clearance 76 pin 60 has additional space in slotted hole 58 so that, preferably in combination with spring 70 provided with an extra stroke, catch 66 can compensate the outward bending of the tubular profile of adjustable fork part 30 and thereby leaves the locking in place.

Slotted hole 58 is also shaped such that there is an additional clearance for pin 60 with which a rotation can be performed in direction C about an axis substantially parallel to direction B. Upper edge 68 of catch 66 can hereby as it were align itself relative to the edge of one of the openings 32, 34 in adjustable fork part 30.

It is possible in the shown embodiment by removing pin 60 to disassemble catch 66 with element 64 in relatively simple manner for the purpose of replacement and/or maintenance. Spring 70 can also be removed here in simple manner from locking mechanism 36.

Providing catch 66 with element 64 as one entity creates a good guiding of a movement of catch 66 with body 64 in locking mechanism 36, thereby avoiding catch 66 being pressed askew.

Catch 66 is preferably made of a high-strength steel whereby, in combination with the rectangular shape of the outer end of catch 66, the surface area can remain relatively limited, and locking mechanism 36 can thereby be applied in relatively thin forks.

During length adjustment of fork 18 pin 60 is displaced in direction B in slotted hole 58 counter to the spring force of spring 70. Catch 66 is here taken out of one of the openings 32, 34 in adjustable fork part 30. In the shown embodiment adjustable fork part 30 can be displaced here via bent edges 50 over guides 48 of fixed fork part 20 by the same user via handle 46 using the other hand. This displacement is continued by the user until catch 66 with element 64 is situated at one of the other openings 32, 34 in adjustable fork part 30. As a result of the action of spring element 64 with catch 66 thereon is pressed wholly or partially into opening 32, 34, whereby a locking of locking mechanism 36 is realized in the new position of fork 18.

When adjustable fork part 30 is loaded, some misalignment of adjustable fork part 30, particularly in the furthest extended position thereof, can occur relative to fixed fork part 20. By providing clearance 76, whereby in this case a small rotation of pin 60 in rotation direction C will occur, upper edge 68 of catch 66 will be aligned with the periphery of opening 32, 34 such that the force is transmitted via a surface and point loads are avoided despite misalignment occurring.

An alternative locking mechanism 80 (FIGS. 4-6) comprises largely the same or similar components as the locking mechanism 36 described and shown above. Alternative locking mechanism 80 is lubricated via connection 82. In the shown embodiment connection 82 is connected via chamber 82 to channel 84 and debouches in lubricator chamber 88 which is provided as recess in locking body 90. Body 90 is also provided with recesses 92. In the shown embodiment pin 94 is provided with stop surface 96. In the shown embodiment passages 98 provide recesses 92 with lubrication.

It will be apparent that diverse measures and components of the shown embodiments are mutually interchangeable or can be applied in similar manner.

Figure 3:
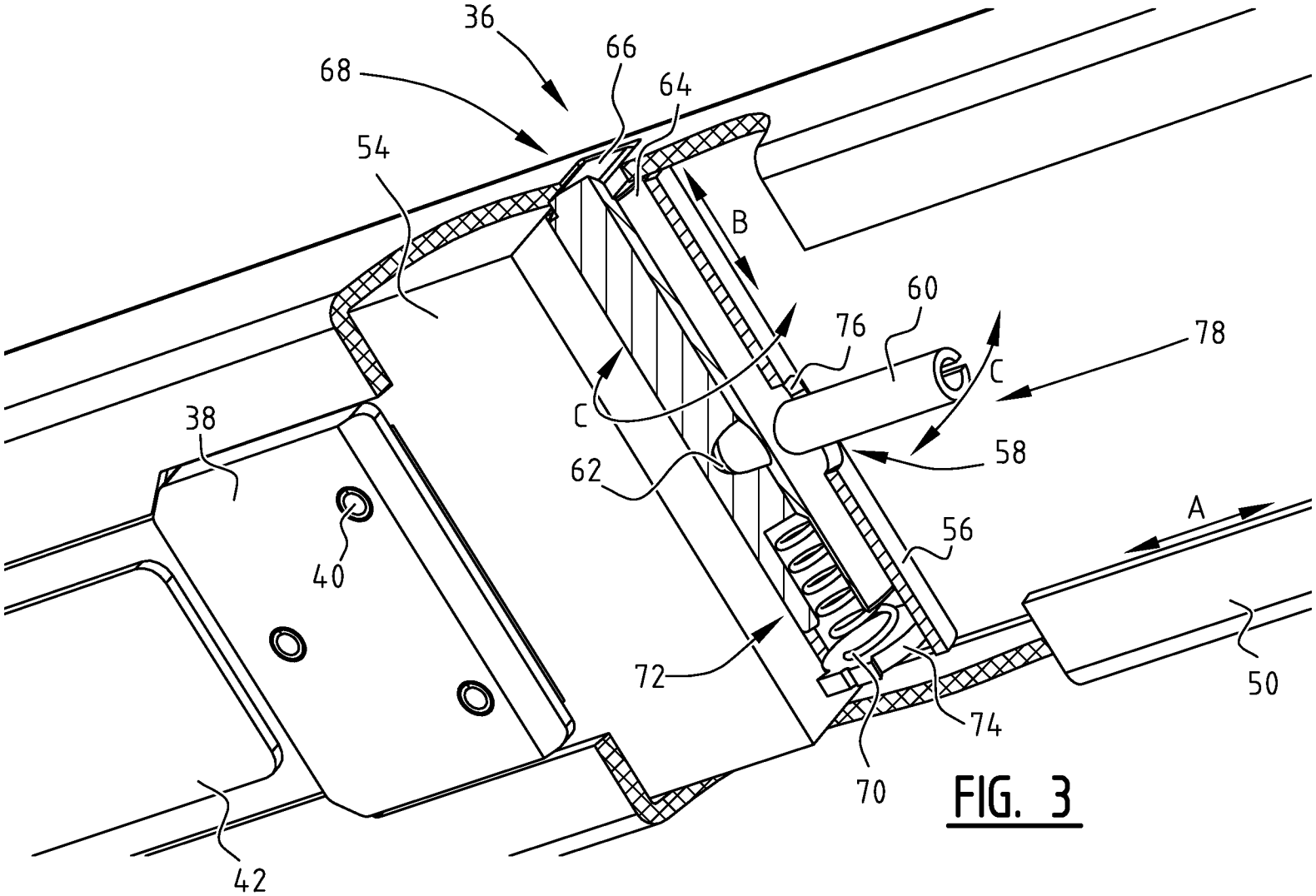
FIG. 3 shows a detail of the locking mechanism of the forks of FIG. 2.
Figure 7:
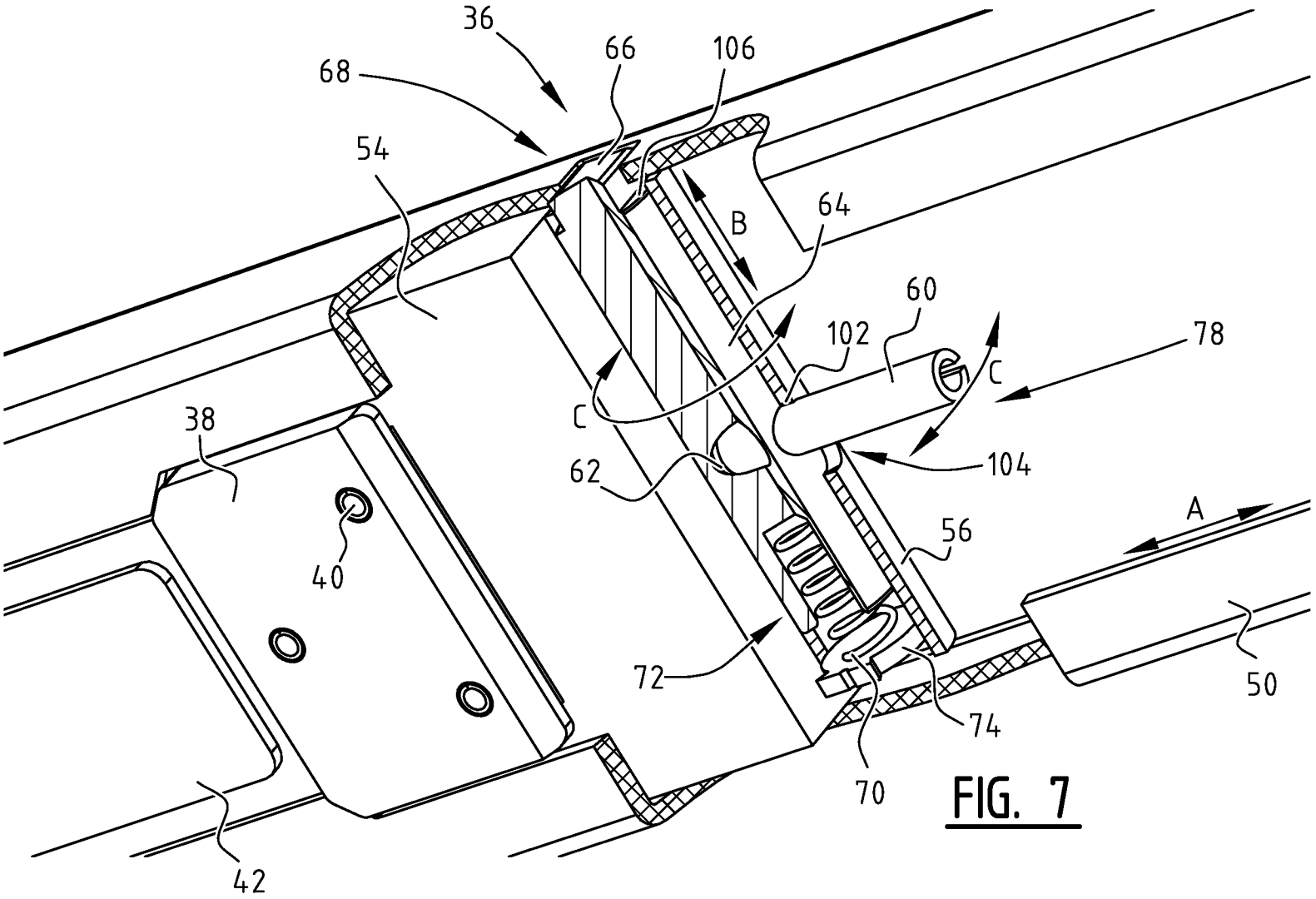
FIGS. 7-10 show alternative embodiments according to the invention.

An alternative embodiment 100 (FIG. 7) is based on the embodiment shown in FIG. 3. In embodiment 100 however, edge 102 of slotted hole 104 arranged in tube or strip 56 forms a stop for pin 60. In the shown embodiment slotted hole 104 (FIG. 7) therefore takes a smaller form than slotted hole 56 (FIG. 3). Transition 106 from rectangular catch 66 to round element 64 is also moved further inward. In this embodiment transition 106 does not therefore lie in any situation against another surface or element. An advantage hereof is that compensation in direction C is even simpler, since the rotation movement can be performed with even less undesirable resistance.

In a further alternative embodiment 108 (FIG. 8) transition 106 from rectangular catch 66 to round element 64 is moved further inward compared to the embodiment shown in FIG. 3. Also provided on tube or strip 56 is an additional stop in the form of edge 110 against which transition 106 comes to lie in a locked situation. A larger stop surface with tongue or edge or ring 110 can be realized compared to embodiment 100 of FIG. 7.

Figure 8:
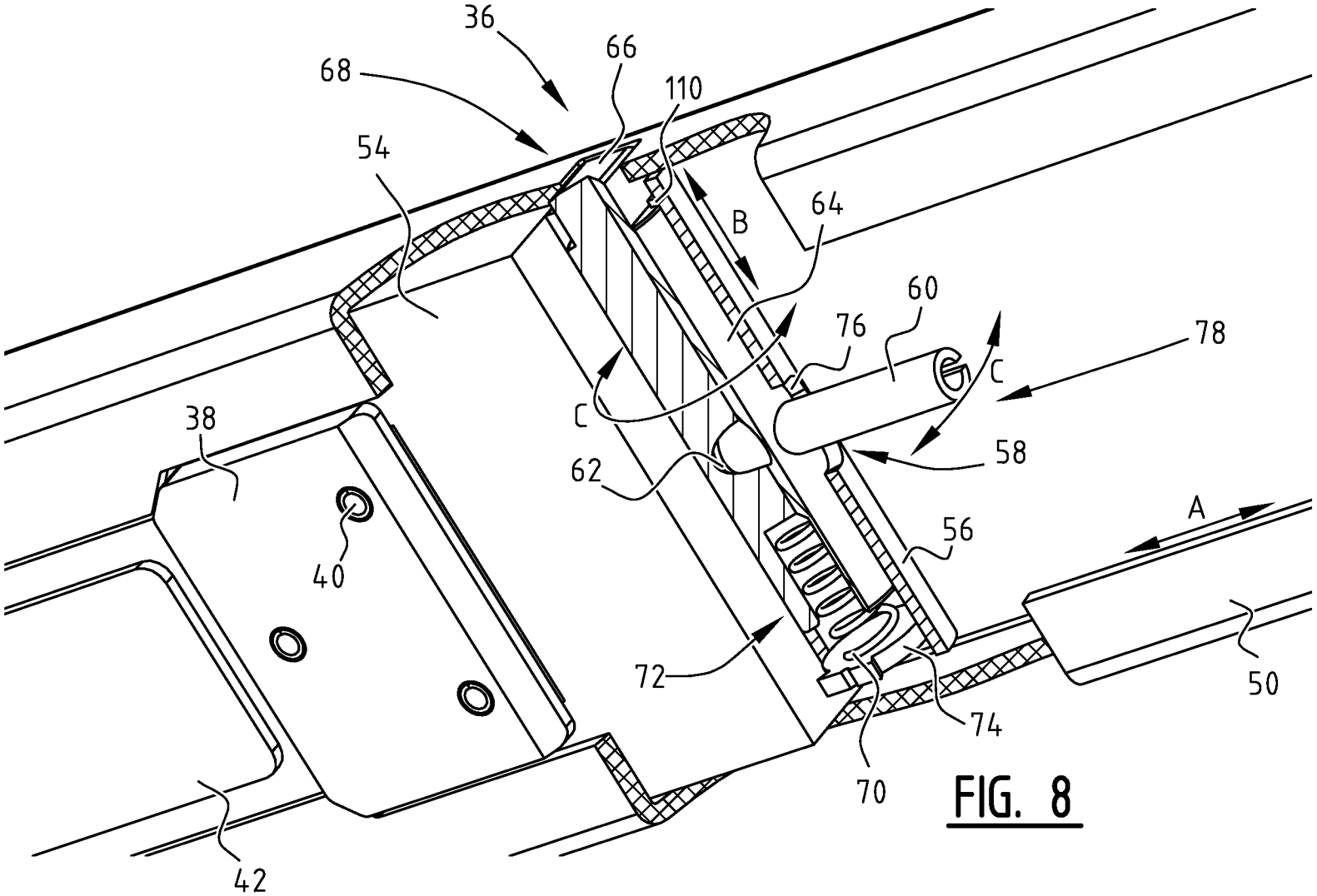

In yet another alternative embodiment 112 (FIG. 9) the tongue or edge 110 is dispensed with when compared to embodiment 108 shown in FIG. 8. Transition 106 is however again moved inward. A covering 114 is also arranged on the outer side of adjustable fork part 30. Covering 114 can be provided as cover plate arranged with a welded or soldered connection. Alternative connections are also among the possibilities. It is also possible to provide a covering 114 by arranging a kind of indentation or recess at the desired location for catch 66 using a punch in a type of deep-drawing process. It is also possible to mill into the side wall of fork part 30 a recess in which catch 66 is provided in the locked situation. This embodiment has the drawback that the wall thickness of the side wall of fork part 30 is reduced at the position of the recess.

Figure 9:
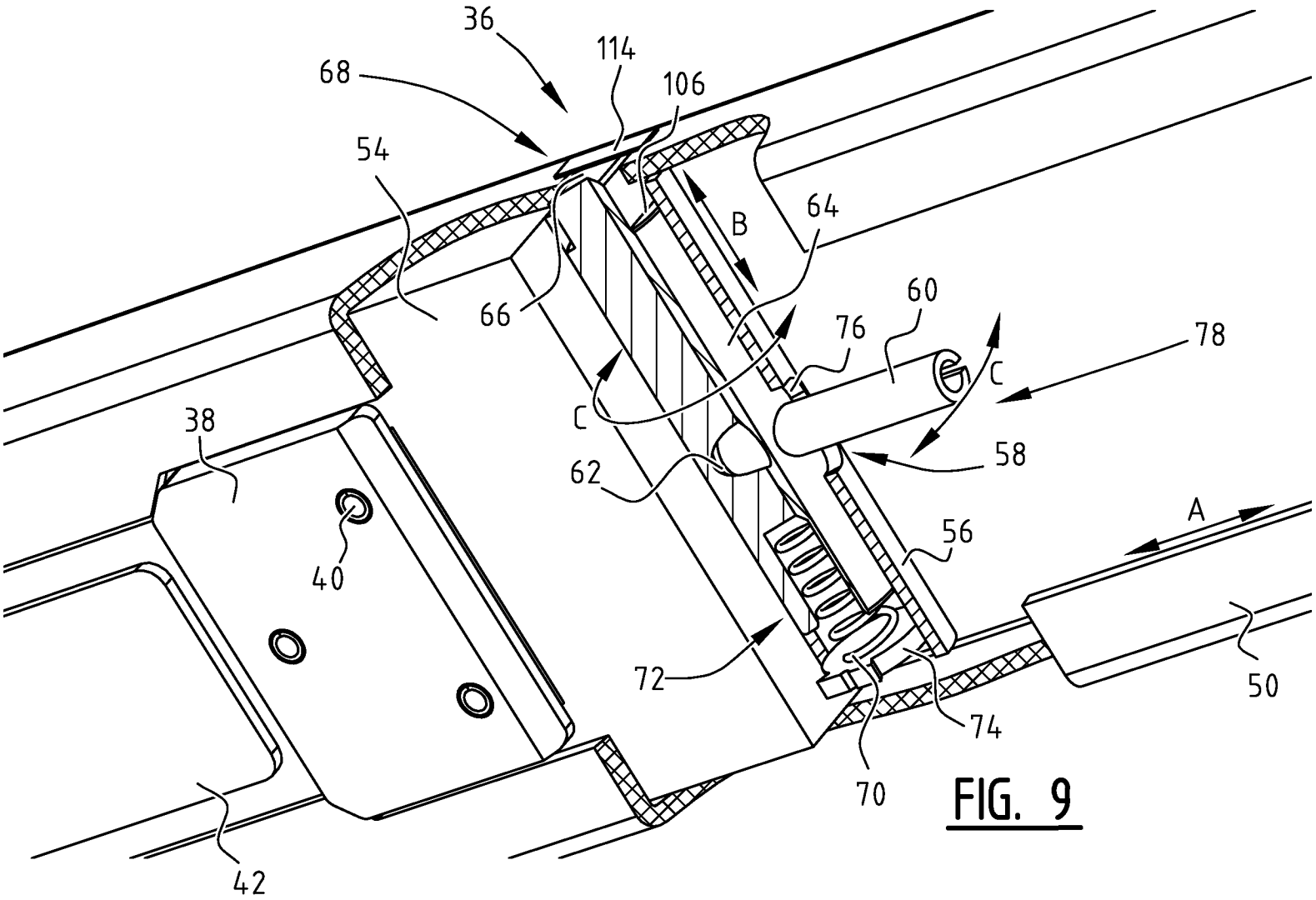
Figure 10:
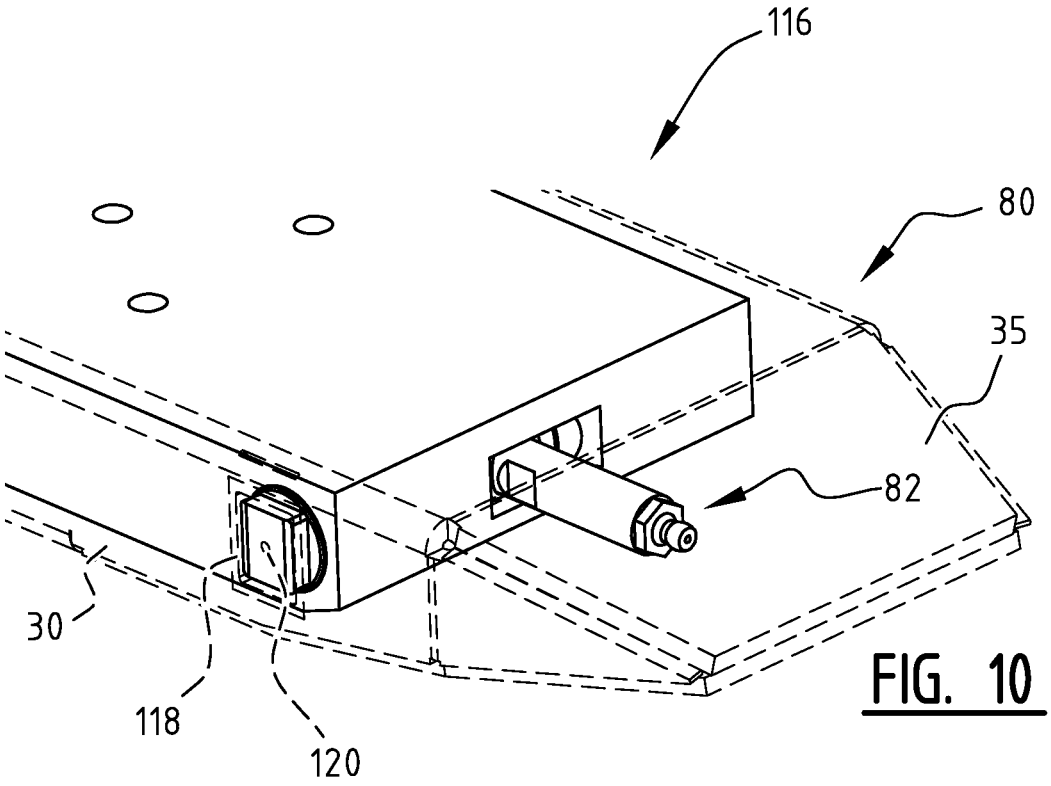

An alternative locking mechanism 116 (FIG. 10) based on mechanism 80 (FIG. 4) can likewise be provided with a covering 118 in similar manner to covering 114 of mechanism 112 of FIG. 9.

An advantage of covering 114, 118 is that no dirt can penetrate. The number of breakdowns and/or contaminants in the mechanism is hereby reduced. A further advantage is that it is possible if desired to dispense with an inclining edge on the outer end of catch 66. A small hole 120 is optionally also arranged in covering 114, 118 for a visual inspection of the locking with catch 66. The foremost surface of catch 66 is further optionally provided here with a different colour or provided in fluorescent or otherwise contrasting manner. Visual inspection of a correct locking is hereby possible. It is also possible to make covering 114, 118 wholly or partially transparent in order to realize a similar effect.

It is the case for all embodiments that the size of catch 66 is not determined by for instance the size of the fingers of a user since operation during adjustment is performed using pin 60. It is thus possible for instance to provide catch 66 with a smaller surface so that breakdowns and/or the danger of penetration of contamination is further reduced.

Figure 4:
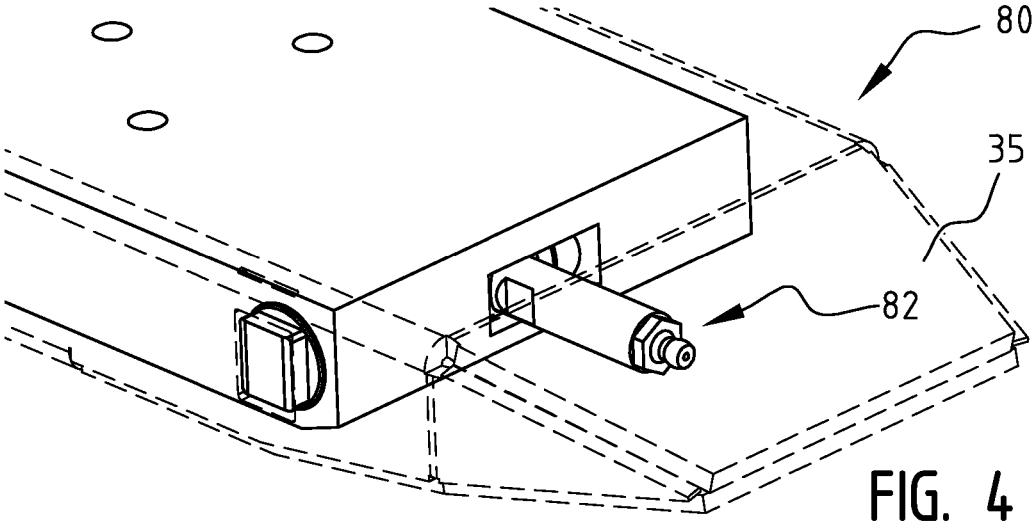
FIGS. 4-6 show an alternative locking mechanism according to the invention.
Figure 5:
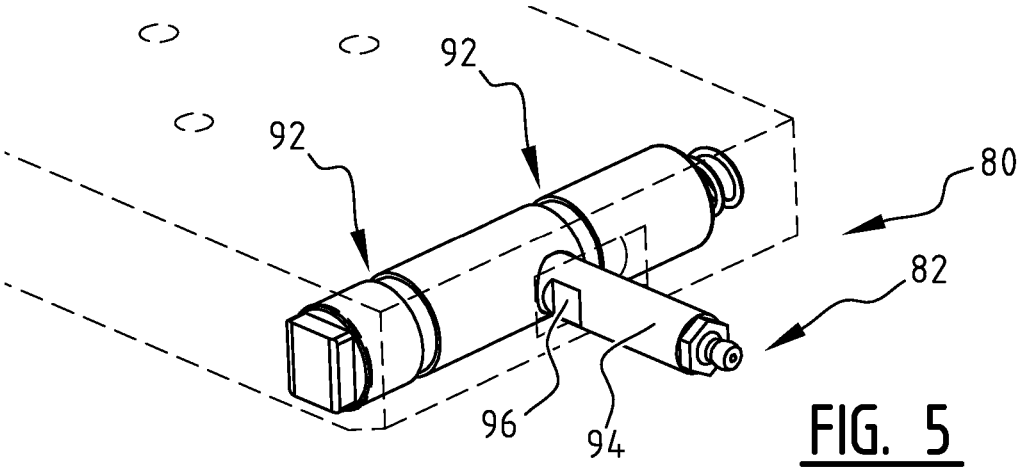
Figure 6:
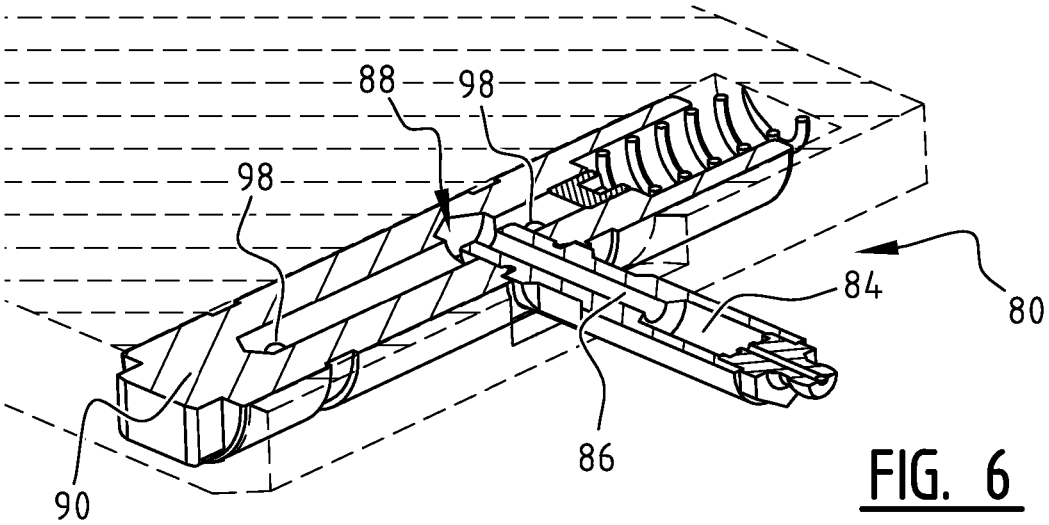

It is thus expressly possible to interchange measures of the locking mechanism of FIG. 3 with measures of the locking mechanism of FIGS. 4-6. Additionally or alternatively, measures of the different alternative embodiments can for instance be interchanged.

The present invention is by no means limited to the above described preferred embodiments thereof. The rights sought are defined by the following claims, within the scope of which many modifications can be envisaged. Locking mechanism 36 can for instance also be applied to types of lifting device other than forklift truck 2, for instance platform lifts and pallet trucks.

The invention claimed is:

1. A manually length-adjustable fork for a lifting device such as a forklift truck, said fork having a first outer end and along a longitudinal axis in a forward direction therefrom a second outer end, said fork comprising:

a fixed fork part;

an adjustable fork part displaceable relative to the fixed fork part and provided from a tubular profile which is open on an underside of the profile; and a locking mechanism connected to the fixed fork part, wherein the locking mechanism is provided with:

a locking catch for locking the adjustable fork part to the fixed fork part;

a spring mechanism operatively connected to the locking catch; and a fastener accessible from the underside of the tubular profile for manual operation of the locking catch from the underside, wherein the fastener is accessible from a forwardly facing side of the locking mechanism and wherein the fastener is attached directly to the locking catch for ease in engaging and disengaging the locking catch wherein the fastener is accessible when the fork is in an elevated position;

wherein the locking mechanism further comprises a fixed part provided with a slotted hole such that the fastener is movable in an adjustment direction therein perpendicular to the longitudinal axis during the manual adjustment of the fork.

2. The manually length-adjustable fork as claimed in claim 1, wherein the slotted hole is provided with a clearance in a direction substantially perpendicular to the adjustment direction such that the locking catch is connectable with the adjustable fork part.

3. The manually length-adjustable fork as claimed in claim 2, wherein the slotted hole of the locking mechanism is provided with an additional outward bending compensation clearance in a direction substantially perpendicular to the adjustment direction.

4. The manually length-adjustable fork as claimed in claim 1, wherein the locking catch is provided with a rectangular form.

5. The manually length-adjustable fork as claimed in claim 1, wherein the locking catch is provided with a locking body which extends in the direction of movement of the catch during locking and unlocking.

6. The manually length-adjustable fork as claimed in claim 1, wherein the fastener is provided removably in the locking mechanism.

7. The manually length-adjustable fork as claimed in claim 1, wherein the locking catch is provided on one side of the fork and moves in a direction B laterally to the fork.

8. The manually length-adjustable fork as claimed in claim 1, wherein the adjustable fork part is provided with a handle for displacing the adjustable fork part relative to the fixed fork part.

9. The manually length-adjustable fork as claimed in claim 1, further comprising a secondary locking arranged on the fixed fork part wherein the secondary locking comprises a wear plate.

10. The manually length-adjustable fork as claimed in claim 1, wherein the locking mechanism further comprises a lubricating means.

11. A forklift truck provided with a manually length-adjustable fork as claimed in claim 1.

12. A method for manually lengthening and/or shortening the manually length-adjustable fork as claimed in claim 1, comprising the steps of:

providing the manually length-adjustable fork;

unlocking the adjustable fork part with the locking mechanism;

displacing the adjustable fork part relative to the fixed fork part from a side facing downward of the fork; and locking the adjustable fork part at a desired position with the locking mechanism.

* * * * *